US006698543B2

(12) United States Patent
Golterman

(10) Patent No.: US 6,698,543 B2
(45) Date of Patent: Mar. 2, 2004

(54) ACOUSTICAL WALL PANELS

(75) Inventor: Herb Golterman, St. Louis, MO (US)

(73) Assignee: Golterman & Sabo, Inc., St. Louis, MO (US)

( * ) Notice: Subject to any disclaimer, the term of this patent is extended or adjusted under 35 U.S.C. 154(b) by 0 days.

(21) Appl. No.: 10/188,155

(22) Filed: Jul. 1, 2002

(65) Prior Publication Data

US 2003/0006091 A1 Jan. 9, 2003

Related U.S. Application Data

(60) Provisional application No. 60/302,404, filed on Jul. 3, 2001.

(51) Int. Cl.[7] ..... E04B 1/82

(52) U.S. Cl. ..... 181/291; 181/290; 181/293

(58) Field of Search ..... 181/284, 287, 181/288, 290, 291, 292, 293

(56) References Cited

U.S. PATENT DOCUMENTS

| | | | | |
|---|---|---|---|---|
| 2,112,631 A | | 3/1938 | MacDonald | |
| 3,095,943 A | | 7/1963 | Kemp | |
| 3,104,731 A | | 9/1963 | Ball, Jr. | |
| 3,324,967 A | | 6/1967 | Robinson | |
| 4,423,573 A | | 1/1984 | Omholt et al. | |
| 4,531,609 A | * | 7/1985 | Wolf et al. | 181/290 |
| 4,611,444 A | | 9/1986 | Nassof | |
| 4,642,951 A | | 2/1987 | Mortimer | |
| 4,706,422 A | | 11/1987 | Ashton | |
| 4,964,250 A | | 10/1990 | Nelson | |
| 4,989,688 A | * | 2/1991 | Nelson | 181/287 |
| 5,202,174 A | | 4/1993 | Capaul | |
| 5,423,151 A | | 6/1995 | Caro et al. | |
| 5,424,497 A | | 6/1995 | Dias et al. | |
| 5,644,872 A | * | 7/1997 | Perdue | 52/144 |
| 6,345,688 B1 | * | 2/2002 | Veen et al. | 181/290 |

* cited by examiner

*Primary Examiner*—Robert Nappi
*Assistant Examiner*—David S. Warren
(74) *Attorney, Agent, or Firm*—Paul M. Denk

(57) ABSTRACT

An acoustical wall panel for use for reduction of sound and noise, including a panel-like structure, formed of a base, generally fabricated of fiberglass, polystyrene, etc., having a covering sheet applied thereon, containing a large number of perforations, to allow noise to pass therethrough, to the sound of absorbing base, the covering sheet being folded over the corners and adhered to itself to provide complete coverage for the side and end edges of the formed panel. A back covering is provided of a foil, polyethylene, or other material, to function as a moisture barrier and protectant for the back of the panel.

9 Claims, 2 Drawing Sheets

ACOUSTICAL WALL PANELS

This application claims the benefit of provisional application No. 60/302,404 filed Jul. 3, 2001.

BACKGROUND OF THE INVENTION

This invention relates generally to acoustical panels, and more specifically to very structurally stable acoustical panels that may be of significant size and be applied directly to the wall, or actually form the wall panel for a divider, to function dually as a divider, but more importantly, to dampen sound, and lessen the noise reversation of the ambient area.

Numerous types of panels have been available in the art, including acoustical panels, for use for sound absorption purposes. And, there are many panels that have been applied to partitions or dividers, such as the type that are used in business offices, to separate work cubicles from one another, but it does not appear that the combination of these two has ever been made, for functioning as an acoustical wall panel, or partition, much less for a large size acoustical panel that can be applied directly to the wall, also for sound control and absorption purposes.

For example, the MacDonald, U.S. Pat. No. 2,112,631, shows a sound absorbing construction, in this case for use upon the ceiling, which includes units formed of relatively thin gauge sheet material. Then, a layer of sound absorbing material is applied thereto. The sound absorbing material appears to be fibrous, and is actually defined as a hairy or felt-like material. These units are then held in place by a series of furring strips, and attaching flanges, for suspension from the ceiling.

The patent to Kemp, U.S. Pat. No. 3,095,943, shows another acoustical structure. It is once again a ceiling type of installation, comprising a perforated cover or pan, having sound deadening material applied therein, which appears to be of a honeycombed structure, filled in, in its cores, with either asbestos, paper, or other core filling material. Once again, these appear to be ceiling acoustical panels.

The patent to Ball, Jr., U.S. Pat. No. 3,104,731, shows another acoustical ceiling. It includes a series of particularly shaped and configured pans, having a fibrous mat of mineral materials applied therein, and the suspended from a ceiling. The pan is perforated to provide for sound admission through its bottom wall.

The patent to Robinson, U.S. Pat. No. 3,324,967, shows an insulating and acoustical panel structure. This is a snap together type of structure, including a bottom section, that combines by a snap connection with a top section, after the body or batt of fibrous material is applied therein. The fibrous material may be formed for rock wool, or the like, to function as a sound and heat insulating material. Once again, this structure is designed to be adhered or suspended from a ceiling.

The patent to Omholt, et al., U.S. Pat. No. 4,423,573, discloses a wall panel with removable acoustical inserts. These panels are for use as a wall, to absorb the incidence of sound, and to prevent the transmission of sound from one location to another, and are structured from a tubular metal frame, that has applied to it an acoustical insert. The acoustical insert includes, and is fabricated, from a central body portion that may be formed from pressed glass fiber, as noted, and has a series of indentations formed therein, and also includes an outer surface covering formed of a fabric, or other sheet material, as noted. While these devices are generally defined as for use as a partition, it does not appear that they are suggested for application to a wall, as a wall panel.

The patent to Nassof, U.S. Pat. No. 4,611,444, shows a sanitary acoustical ceiling. This type of a ceiling is of a very specific design, including the application of particularly designed metal ceiling panels, that are only perforated along the sides, and have the acoustical insulation material applied therein. These are designed for hospitals, kitchens, and the like, generally areas that must be kept in a sanitary condition.

The patent to Mortimer, U.S. Pat. No. 4,642,951, shows another suspended ceiling tile system. This device is made of a variety of ceiling tiles, structured differently from the current design, and functions for a different purposes.

The patent to Ashton, U.S. Pat. No. 4,706,422, discloses a space divider. This space divider is formed of an outer fabric covering 26, having internal panels forming side walls that have a series of apertures provided through them, and formed having a series of intersecting stiffeners, within them, and in which bats of acoustical insulating material may be applied, when forming the structure.

The patent to Nelson, U.S. Pat. No. 4,964,250, shows a modular acoustical panel and method of making same. While these acoustical panels, as shown therein, may be fabricated of a variety of structures, having layers of insulating material therein, the particular modular acoustical panels as defined in this patent depict panels that are structured quite distinct and different from that of the current invention.

The patent to Capual, U.S. Pat. No. 5,202,174, shows another lay-in ceiling panel construction.

The patent to Caro, et al, U.S. Pat. No. 5,423,151, shows a tackable tile. While these tiles may be used to form walls, as can be noted, the tackable tiles are formed specifically as a tile frame, including a composite tackable member conforming to the perimetric shape of the tile frame, and mounted in its opening, is an acoustical layer of material. This patent does disclose a layer of polymeric material, which is resilient and flexible, but it must also be pierceable, having a layer of acoustic material applied to the rear face, it must be adapted to have a tack inserted from the front face, and which passes into the polymeric material, and into the acoustical layer, apparently to retain the tiles structurally together.

Finally, the patent to Dias, et al., U.S. Pat. No. 5,424,497, shows a sound absorbing wall panel. While this panel is designed for that purpose, for use as a wall panel, and for sound absorbing purposes, its particular structure is entirely distinct from the structured and more simplified acoustical sound panel of this current invention.

SUMMARY OF THE INVENTION

The principal object of this invention is to provide an acoustical wall panel that may be applied directly to the wall, and thereat provide sound absorption attributes that effectively dampen the acoustical reverberations of sound, from the ambient environment. For example, this invention can be applied in auditoriums, terminals, such as airline terminals, offices, restaurants, and other locations where the level of noise from predominantly crowds of people, are otherwise bothersome, or make it difficult to hear, but which can be lessened, to some degree, through the application of panels of this invention.

This invention contemplates the formation of a panel-like structure, which in the preferred embodiment, may be in the range of four feet by eight feet panels, or could be of smaller design, or even larger construction, if desired. Essentially, the essence of the invention is the provision of a base within the formed panel, which can function for sound absorption purposes, to reduce the ambient noise, to the satisfaction of the persons in the vicinity of this acoustical wall panel.

The base structure of this invention includes a sizable sheet of sound absorption material, having structural integrity, and which may be fabricated of fiberglass, although perhaps expanded polystyrene, or other type of porous material, that would have a tendency to absorb sound, may be employed and work just as effectively as the base structure for this invention. The base structure then includes a covering sheet, of durable flexible material, and which may be formed, for example, of a copolymer, such as vinyl, acrylic, polyethylene, or any other type of natural material, such as leather, or synthetic, like a polymer, sheet material, that may be flexibly applied to the surface of the base structure, folded over on the ends or sides, with any remaining flaps tucked in, while the adjacent flanges are also turned down, adhered in place, to form a covering like sheet entirely over the exposed surface and edges of the base structure. Such covering material will need to be perforated, through a plurality of arranged apertures, to allow for entrance of any sound to attain access to the acoustically dampening material forming the base structure, to allow entrance, and then absorption, of the ambient sound, after the panel is applied. The backside or base of the panel, and that surface which will be applied either directly to, or hung upon, the wall of the building structure, will have a covering of a moisture barrier type of material, such as another sheet of polymer material, such as polyethylene, or foil, that will be adhered by adhesive directly to the exposed rear face of the base structure, and thereat function as a moisture barrier, a barrier to prevent rodents or other insects to attain access into the acoustical base structure, and also provide a surface to which an adhesive may be applied, when these panels are attached to an adjacent wall, for sound absorption purposes. Even if the panel is hung to the wall, the moisture barrier will still be effective at preventing the migration of any moisture, into the base structure, while it suspended over an extended period of time.

The panels of this invention may likewise be used for forming partition panels, such as in partitions that are used normally within businesses to form personnel operating cubicles, and the operating, and which preferably require the need for some sound absorption, or dampening of sound, in order to assist in the preservation of the confidential information that be discussed by the worker occupying the business cubicle at any given time.

These are examples as to how the acoustical wall panels of this invention may be effectively and advantageously used.

The principal object of this invention is to provide an acoustical wall panel for use for absorbing sound.

Another object of this invention is to provide such a panel that can effectively decrease the decibels of ambient sound by some significant percentage.

Still another object of this invention is to provide an acoustical wall panel, which has structural integrity through the fabrication of its base structure per se, and then which may be covered by a perforated sheet, that affords durability and endurance to the wall panel, while simultaneously enhancing their appearance upon those surfaces that are exposed to viewing.

Still another object of this invention is to provide an acoustical wall panel that may apply a decorative print thereon, to enhance the appearance of the acoustical wall panel during its usage and application.

Still another object of this invention is to provide an acoustical wall panel covered by a durable sheet material which has such strength and endurance that it can resist the normal and routine deterioration that it is normally exposed to, during sustained usage in a highly active area.

Another object of this invention is to provide an acoustical wall panel that includes a vapor barrier, upon that surface which is applied to the wall, or the like, to prevent the entrance of any humidity or moisture therein, which would otherwise reduce or detract from the sound absorbing characteristics of its base structure.

These and other objects may become more apparent to those skilled in the art upon review of the invention as shown and described herein, and as specifically analyzed in the description of the preferred embodiment.

BRIEF DESCRIPTION OF THE DRAWINGS

In referring to the drawings, FIG. 1 provides an isometric view of the acoustical wall panel of this invention.

DESCRIPTION OF THE PREFERRED EMBODIMENT

Figure 1:
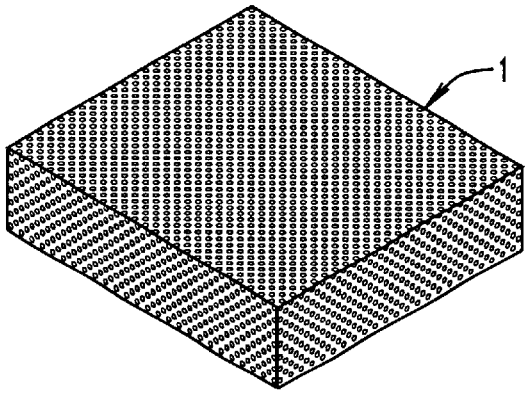
Figure 2:
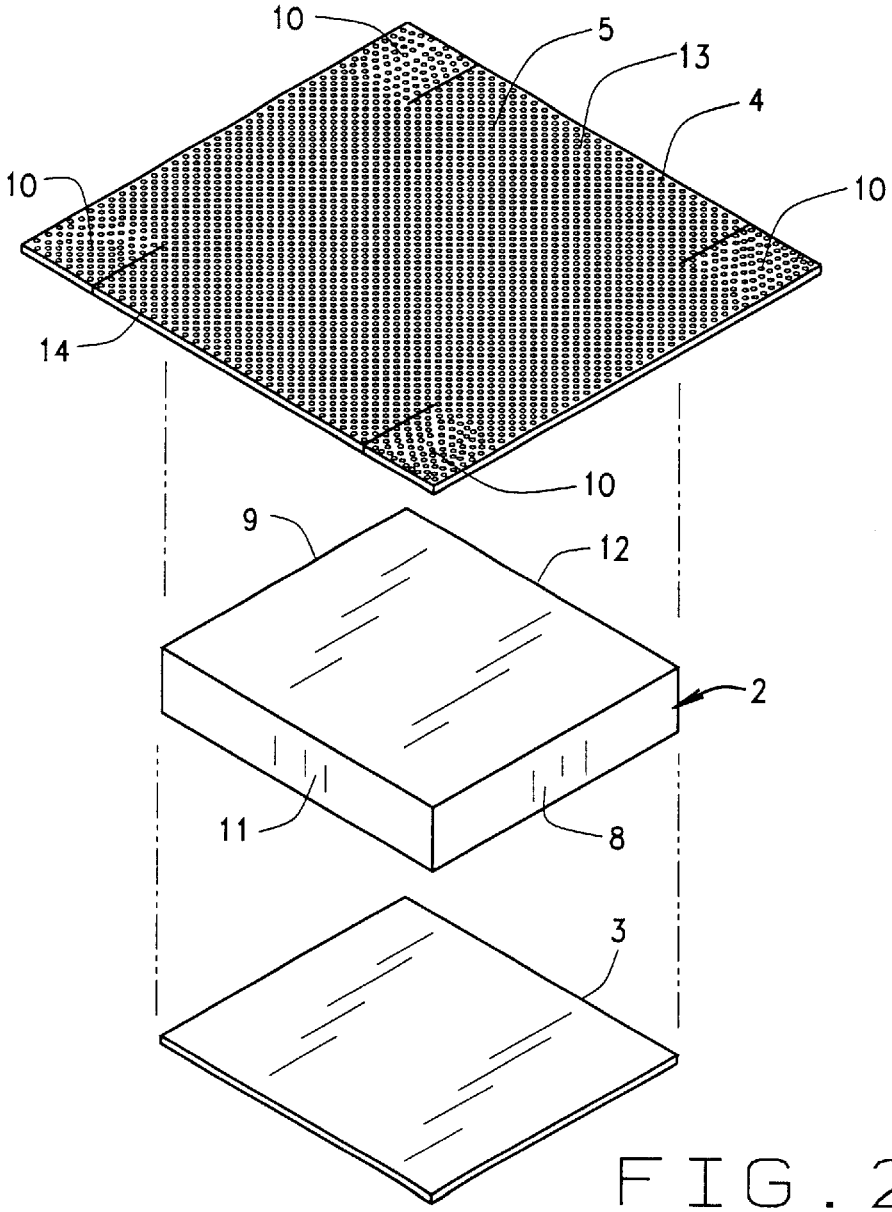
FIG. 2 shows an exploded view of the various components during their assembly into the acoustical wall panel of this invention.

In referring to the drawings, FIG. 1 shows the acoustical wall panel 1 of this invention. As can be seen in FIG. 2, the panel includes a base structure 2, which, as previously described, may be made of any sound absorbing material, such as fiberglass, polystyrene, or any other type of porous material that is susceptible to absorb some degree of ambient sound, when properly applied. The base structure may typically be formed of sheet type material, having sufficient internal integrity, so as to provide rigidity to the panels once formed. These panels may be of one, two, or three, or more inches of thickness, and may have overall dimensions that can be anywhere in the range of four feet to eight feet in size, may even be made to smaller dimensions, or even larger, if required. The base structure 2 has a vapor barrier 3 applied to its backside, and this vapor barrier may be a foil, a reinforced foil, any type of polyethylene vapor barrier, glassine paper, oil paper, or the like, that effectively prevents the entrance of moisture therethrough. The cover 4 for the panel includes a generally rectangular or square sheet of flexible covering material, which, as previously described, will be of sufficient strength to prevent deterioration from proximate activity, preferably prevent tearing in the event that anyone nearby should poke it with a sharp instrument, or inadvertently hook onto it, and generally may be fabricated of a heavy copolymer, such as vinyl, acrylic, may even be formed of leather, or any other type of covering material that is of sufficient strength to resist tearing, but at the same time, enhance the appearance of the wall panels, once assembled. Each of the panels includes a series of apertures or round or other shaped holes 5 therethrough, and which holes may be aligned, or arranged in a staggered pattern, when formed. The surface covering for the panels may include any type of decorative print, or be made or tinted to a color at the specification of the developer, so that they may complementary fit with the style or fashion of the building and wall to which these panels are suspended and adhered.

Figure 3:
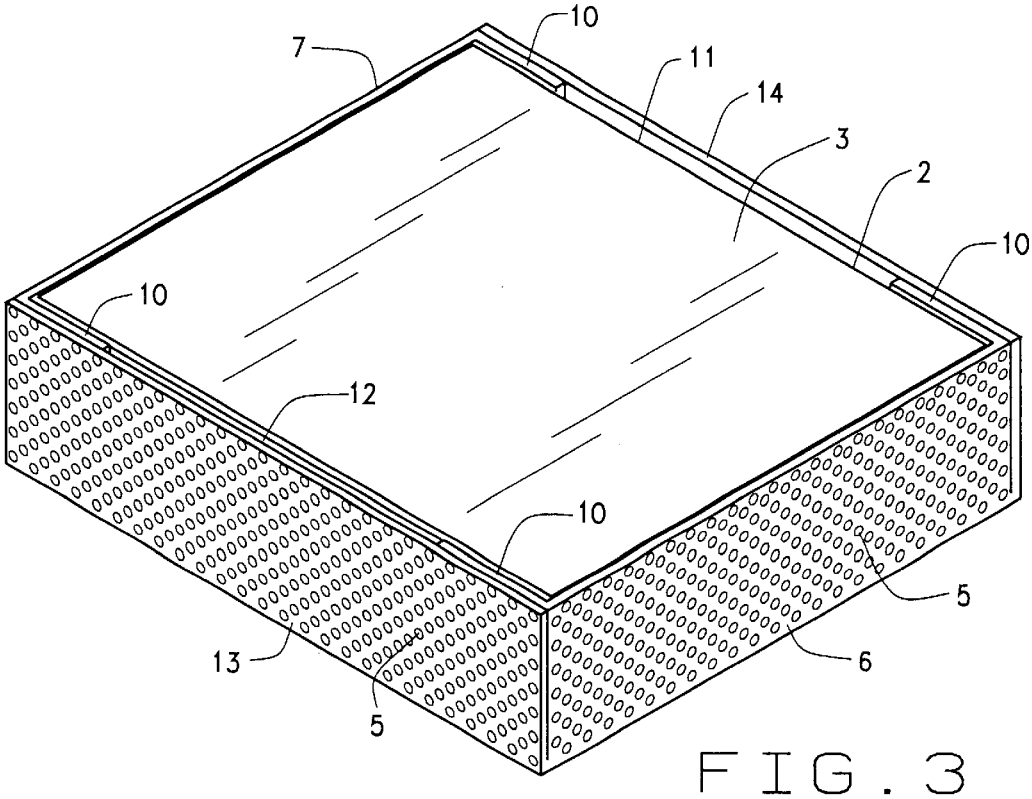
FIG. 3 shows a backside view of the acoustical wall panel of FIG. 1.

As can be seen in the back view of FIG. 3, when the covering material 4 is applied over the front face of the base structure 2, its end flanges or walls 6 and 7 are folded over, and adhered, or held in position, with the contiguous end edges 8 and 9 of the base structure 2. At this time, its side flanges 10 are folded proximate the side edges 11 and 12, at which time the sides 13 and 14 are folded over, into proximity with the said side edges 11 and 12, and adhered, as by an adhesive, or other fastening means, to the end edge flanges 10, as can be noted. This provides the full covering for the base structure 2, and forms the type of panel as can be seen in FIG. 1.

As can also be seen, the variety of apertures 5 are arranged in a staggered pattern throughout and extend all the way through the cover sheet 4, as formed. In addition, even prior or subsequent to the formation of the plurality of apertures through the cover sheet, a decorative pattern may be printed upon the surface of the cover sheet 4, as previously reviewed. This can be done by specification, to meet the requirements of the developer, or interior decorator, requesting such panels.

Figure 4:
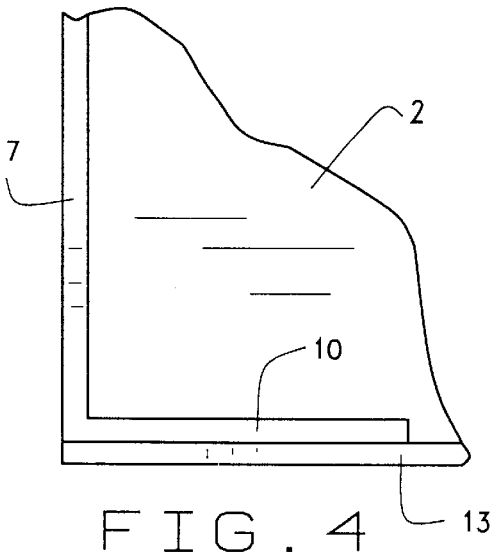
FIG. 4 is a typical corner detail taken along the back view of the panel of this invention.
Figure 5:
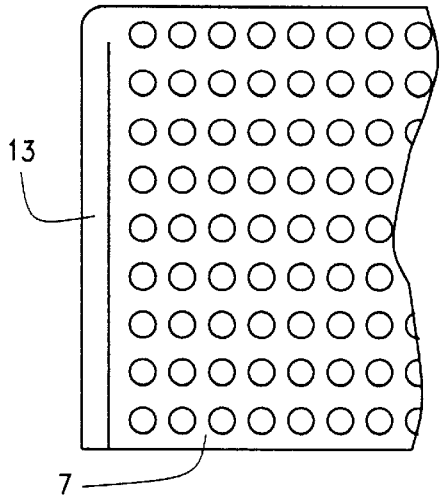
FIG. 5 is a typical corner detail from a side view of the acoustical wall panel of this invention.

As can also be noted in FIGS. 4 and 5, the interconnection between the side flanges 13, and the underlying end tabs 10, as by an adhesive connection, or other means of attachment, can be readily seen.

As previously summarized, the variety of apertures furnished through the covering sheet 4, and which provide direct access to the sound absorbing material therein, forming the base structure 2, have been tested to determine the ability of these panels to absorb sound, the approximate amount of decibel level reduced, and the percentage that noises dampen, through research and experimentation. It has been found for the typical four feet by eight feet panel, having a two inch thickness, that the ambient level of noise is reduced by an approximate 100% for each square foot of panel, when a panel of this type is applied adjacent the wall of a normally noise laddened area. Thus, the effectiveness of these panels for sound dampening alone, has been determined to be effective, for that technical purpose alone. This is notwithstanding the fact that the same panels can be used for wall decorations, to enhance the appearance of the surrounding area, or these panels also may be used for the formation of business office centers, such as a business cubicle, within a multi-employee location.

These are examples of the technical effectiveness of this invention, when installed for these types of purposes.

Variations of modifications to the subject matter of this invention may occur to those skilled in the art upon reviewing the development as described herein. Such variations, if within the scope of this development, are intended to be encompassed within the invention as shown and described. The description of the preferred embodiment, and as illustrated in the drawings, is provided for just that purpose, for illustrative purposes only.

What is claimed is:

1. A panel-like structure for use for forming an acoustical wall panel, said panel including a base structure, said base structure having sufficient structural integrity to form a rigid wall panel and comprising a sheet of sound absorbing material selected from the group consisting of fiberglass, expanded polystyrene, and other porous sound absorbing type material, a covering sheet of durable flexible material, providing a wrap for application to the surface of the base structure, said durable flexible covering sheet being selected from the group comprising a copolymer, vinyl, acrylic, polyethylene, leather, and other synthetic flexible sheet material, said covering sheet being applied to the surface of the base structure, said covering sheet being folded over around the ends and sides of the base structure, said covering sheet including a series of perforations, to allow the permeation of sound to be absorbed by the base structure, and the back of the base structure having a covering sheet material adhesively applied directly to the exposed rear face of said base structure.

2. The acoustical wall panel of claim 1 wherein said covering material for the rear face of the base structure comprising a moisture barrier type sheet.

3. The acoustical wall panel of claim 2 wherein said wall panel may be adhesively applied to a contiguous wall.

4. The acoustical wall panel of claim 2 wherein said panel may be hung upon a contiguous wall.

5. The acoustical wall panel of claim 2 wherein a plurality of said panels may form a partition panel for use in creating operating cubicles for personnel within an office.

6. The acoustical wall panel of claim 2 wherein the perforated covering sheet, in combination with the sound absorbing base structure effectively decreasing the decibels of the ambient sound by some amount.

7. The acoustical wall panels of claim 2 wherein said panels may include a supporting base, and said panels being provided for free standing during usage upon its supporting base.

8. The acoustical wall panels of claim 2 wherein the remaining flaps of the folded over covering sheet are tucked into a laminar disposition, and disposed substantially flattened upon the backside of the covered base structure.

9. The acoustical wall panel of claim 8 wherein the covering material applied to the backside of the panel overlapping the tucked in portions of the covering sheet.

* * * * *